US009114400B2

(12) United States Patent
Seto et al.

(10) Patent No.: US 9,114,400 B2
(45) Date of Patent: Aug. 25, 2015

(54) GRINDING TYPE VERTICAL GRAIN MILLING MACHINE

(75) Inventors: Yasuyoshi Seto, Tokyo (JP); Kazunobu Kajihara, Tokyo (JP); Kazuto Nonaka, Tokyo (JP); Yasunori Koike, Tokyo (JP); Koji Yamamoto, Tokyo (JP)

(73) Assignee: SATAKE CORPORATION, Tokyo (JP)

( * ) Notice: Subject to any disclaimer, the term of this patent is extended or adjusted under 35 U.S.C. 154(b) by 1020 days.

(21) Appl. No.: 13/137,755

(22) Filed: Sep. 9, 2011

(65) Prior Publication Data

US 2012/0067990 A1 Mar. 22, 2012

(30) Foreign Application Priority Data

Sep. 17, 2010 (JP) ..... 2010-209921

(51) Int. Cl.

| | |
|---|---|
| ***B02C 21/00*** | (2006.01) |
| ***B02B 3/04*** | (2006.01) |
| ***B02C 7/08*** | (2006.01) |
| *B02C 7/13* | (2006.01) |

(52) U.S. Cl.

CPC ... *B02B 3/04* (2013.01); *B02C 7/08* (2013.01); *B02C 7/13* (2013.01)

(58) Field of Classification Search

CPC ..... B02C 7/08; B02C 7/13
USPC ..... 241/60, 74, 257.1, 260
See application file for complete search history.

(56) References Cited

U.S. PATENT DOCUMENTS

| | | | | |
|---|---|---|---|---|
| 5,048,407 | A | 9/1991 | Salete-Garces | |
| 5,295,629 | A * | 3/1994 | Satake et al. | 241/57 |
| 5,394,792 | A * | 3/1995 | Satake et al. | 99/519 |
| 5,395,059 | A | 3/1995 | Satake et al. | |
| 5,419,252 | A * | 5/1995 | Satake | 99/519 |
| 5,511,469 | A | 4/1996 | Satake et al. | |
| 5,752,664 | A * | 5/1998 | Satake et al. | 241/74 |

FOREIGN PATENT DOCUMENTS

| | | |
|---|---|---|
| CN | 2055742 U | 4/1990 |
| CN | 1051685 A | 5/1991 |
| CN | 1114914 A | 1/1996 |

(Continued)

OTHER PUBLICATIONS

Japanese Notification of Reasons for Refusal dated Dec. 26, 2013 in Japanese Patent Application 2010-209921.

*Primary Examiner* — Faye Francis
(74) *Attorney, Agent, or Firm* — Staas & Halsey LLP

(57) ABSTRACT

A grinding type vertical grain milling machine is capable of shortening a dimension of a machine body in the vertical direction and removing bran by evenly suctioning an entire bran removing chamber. The grinding type vertical grain milling machine includes a bran removing metallic mesh cylinder with a main shaft, an integral grinding type grain milling roll body, a bran removing chamber, and a bran discharge pipe that discharges bran to the outside of the machine. A fan-pulley is provided between the bran removing chamber and the bran discharge pipe. The fan-pulley rotationally drives the main shaft to which the grinding type grain milling roll is axially attached and generates a bran removing wind to convey bran produced by the grain milling action of the grinding type grain milling roll from the bran removing chamber toward the bran discharge pipe.

4 Claims, 7 Drawing Sheets

(56) References Cited

FOREIGN PATENT DOCUMENTS

| | | | |
|---|---|---|---|
| CN | 1153082 | A | 7/1997 |
| CN | 2584888 | Y | 11/2003 |
| CN | 1986063 | A | 6/2007 |
| CN | 101780424 | A | 7/2010 |
| JP | 29-16422 | | 12/1954 |
| JP | 54-90556 | | 12/1977 |
| JP | 55-088645 | | 12/1978 |
| JP | 03-178343 | | 8/1991 |
| JP | H07-136527 | | 5/1995 |
| JP | H08-332399 | | 12/1996 |
| JP | 3201496 | | 6/2001 |
| JP | 2006-205137 | | 8/2006 |
| JP | 2007-268482 | | 10/2007 |
| JP | 4481269 | | 3/2010 |

* cited by examiner

CROSS-SECTION ALONG A-A

GRINDING TYPE VERTICAL GRAIN MILLING MACHINE

BACKGROUND OF THE INVENTION

1. Field of the Invention

The present invention relates to a grinding type vertical grain milling machine in which a cylindrical grinding type grain milling roll body is attached to a main shaft perpendicularly supported to a body base.

2. Description of the Related Art

An existing grinding type vertical grain milling machine is disclosed in Japanese Patent Nos. 3201496 and 4481269. The milling machine will be described with reference to the drawings. FIG. 6 is a longitudinal sectional view of the milling machine disclosed in Japanese Patent No. 3201496. A hollow main shaft 103 of which the lower end is opened is uprightly formed (perpendicularly supported) at the substantial center of the body base 102 by an upper bearing portion 105 and a lower bearing portion 104. Then, a plurality of annular grinding type grain milling rolls 107 are placed to overlap each other directly above the upper bearing portion 105, whereby a cylindrical integral grain milling roll body is formed. A bran removing metallic mesh cylinder 119 is uprightly formed around the grinding type grain milling roll 107 with a gap therebetween, and a bran removing cover 125 is attached around the bran removing metallic mesh cylinder 119 with a gap therebetween. The gap (space) between the bran removing metallic mesh cylinder 119 and the bran removing cover 125 forms a bran removing chamber 126. Then, an annular bran collecting chamber 150 is formed below the bran removing chamber 126, and the bottom surface thereof is provided with a bran discharge port 153. The bran piled on the bottom surface on the bran collecting chamber 150 is conveyed toward the bran discharge port 153 by a scraping blade 152 sliding on the bottom surface of the bran collecting chamber 150, is suctioned through the bran discharge port 153 and an air discharge pipe 154 by a bran collecting fan 155, and then is discharged to the outside.

However, in the grinding type vertical grain milling machine with the above-described configuration, a problem arises in that the dimension of the machine body in the vertical direction increases due to the configuration in which the hollow main shaft 103 is uprightly formed at the substantial center of the body base 102 by the upper bearing portion 105 and the lower bearing portion 104 and the configuration in which the annular bran collecting chamber 150 is formed below the bran removing chamber 126. Further, in the configuration in which the bran piled on the bottom surface of the bran collecting chamber 150 is conveyed by the scraping blade 152 toward the bran discharge port 153, there are problems in that the number of components increases and the configuration becomes complex.

On the other hand, in the grinding type vertical grain milling machine disclosed in Japanese Patent No. 4481269, the bran is removed without using the scraping blade. That is, referring to FIG. 7, in the vertical milling machine, a guide plate 139 and at least one partitioning plate 143 are disposed at the outer periphery of the bran removing cylinder 114. The guide plate 139 is inclined relative to the horizontal direction so as to guide bran powder to a suction duct portion 132, and the partition plate 143 defines the bran removing chamber 124 in the vertical direction and the lower end thereof is separated from the top surface of the guide plate 139 by a predetermined distance. Due to the configuration of the guide plate 139 and the arrangement of the partition plate 143, even when the volume of air suctioned from the suction duct portion 132 decreases, the bran powder discharged from the grain milling chamber to the bran removing chamber 124 may be guided to the suction duct portion 132 and the bran powder may be discharged from the suction duct portion 132. Accordingly, it is possible to prevent the bran powder from being accumulated inside the bran removing chamber 124.

The vertical milling machine of FIG. 7 devises a method of obtaining an even suction force in the entire bran removing chamber 124 by providing the partition plate 143, but the suction force may be uneven depending on the space where the partition plate 143 is provided.

SUMMARY OF THE INVENTION

The present invention is made in view of such problems, and it is an object of the invention to provide a grinding type vertical grain milling machine capable of shortening a dimension of a machine body in the vertical direction and removing bran by evenly suctioning an entire bran removing chamber.

The present invention provides a grinding type vertical grain milling machine solving the problems by the following technical spirit.

According to an aspect of the present invention, there is provided grinding type vertical grain milling machine includes: a main shaft that is perpendicularly and rotatably supported to a body base; a grinding type grain milling roll body that is formed in a cylindrical shape in the vertical direction by disposing a plurality of annular grinding type grain milling rolls in multiple stages; a cylindrical bran removing metallic mesh cylinder; a cylindrical bran removing cover; and a bran discharge pipe.

The grinding type grain milling roll body is attached to the main shaft so as to rotate together with the main shaft, and the bran removing metallic mesh is disposed outside the grinding type grain milling roll body to be fixed to the body base and forms a grain milling chamber between the bran removing metallic mesh and the grinding type grain milling roll body.

The bran removing cover is disposed outside the bran removing metallic mesh to be fixed to the body base and forms a bran removing chamber between the bran removing cover and the bran removing metallic mesh.

Further, the bran discharge pipe is disposed so as to communicate with the lower portion of the bran removing chamber.

Then, a fan-pulley is disposed at the communication portion between the bran removing chamber and the bran discharge pipe, the fan-pulley having a function of rotationally driving the main shaft and a function of generating a bran removing wind for conveying bran produced by a grain milling action of the grinding type grain milling roll body from the bran removing chamber toward the bran discharge pipe.

The fan-pulley may include: a boss portion that is fitted to the main shaft to which the grinding type grain milling roll body is attached, a rim portion on which a rotationally driving conveying belt is mounted, and a plurality of arm portions that connect the boss portion and the rim portion to each other and is formed in an axial fan blade shape inclined from the horizontal direction.

A body base portion supporting the main shaft and a motor as a driving source may be disposed below the main shaft, a motor pulley may be attached to the motor, a conveying belt may be wound between the motor pulley and the fan-pulley, and a moving device may be attached to the body base portion so as to adjust a distance between the shafts of the motor pulley and the fan-pulley by moving the motor base relative to the body base portion in the horizontal direction.

A lower portion of a rim portion of the fan-pulley may be provided with an inner edge formed by protruding the inner periphery of the rim portion downward, an upper portion of the rim portion may be provided with an outer edge formed by protruding the outer periphery of the rim portion upward, the bran discharge pipe may be provided with an outer receiving flange receiving the inner edge from the outside thereof, and the bran removing chamber may be provided with an inner receiving flange received inside the outer edge.

The diameter of the fan-pulley may be set to from 600 mm to 800 mm and the number of rotations thereof may be set from 500 rpm to 700 rpm.

According to an aspect of the invention, since the fan-pulley is provided, the rotation is transferred from the driving source to the main shaft, and the bran removing wind is generated. Accordingly, it is not necessary to provide the annular bran collecting chamber provided below the bran removing chamber provided to discharge the bran and the scraping blade sliding on the bottom surface of the annular bran collecting chamber. Therefore, since the installation space thereof is not needed, the dimension of the machine body in the vertical direction may be shortened in the grinding type vertical grain milling machine.

According to an aspect of the invention, since the arm portion is formed in the axial fan blade shape inclined from the horizontal direction and generates a bran removing wind to evenly suction the entire bran removing chamber downward. Therefore, the bran may be extremely efficiently discharged from the bran removing chamber toward the bran discharge pipe.

According to an aspect of the invention, since the body base portion supporting the main shaft and the motor as the driving source are disposed below the main shaft, the motor pulley is axially attached to the motor, the conveying belt is wound between the motor pulley and the fan-pulley, and the moving device is attached to the body base portion so as to adjust a distance between the shafts of the motor pulley and the fan-pulley by moving the motor base relative to the body base portion in the horizontal direction, the tension of the conveying belt may be simply adjusted.

According to an aspect of the invention, since there are provided the inner peripheral edge protruding toward the lower portion of the rim portion of the fan-pulley, the outer peripheral edge of the upper portion of the rim portion, the outer receiving flange near the bran discharge pipe, and the inner flange near the bran removing chamber, it is possible to prevent the bran from being dropped over the pulley even when the pulley rotates when the bran flows from the bran removing chamber into the fan-pulley and to prevent the bran from being dropped over the bran discharge pipe even when the pulley rotates when the bran flows from the fan-pulley into the bran discharge pipe.

According to an aspect of the invention, since the diameter of the fan-pulley is set to from 600 mm to 800 mm and the number of rotations thereof is set from 500 rpm to 700 rpm, it is possible to generate a weak bran removing wind contributing to rapid bran discharging without scattering dust around the milling machine.

DETAILED DESCRIPTION OF THE PREFERRED EMBODIMENTS

An embodiment of the present invention will be described with reference to the drawings.

Figure 1:
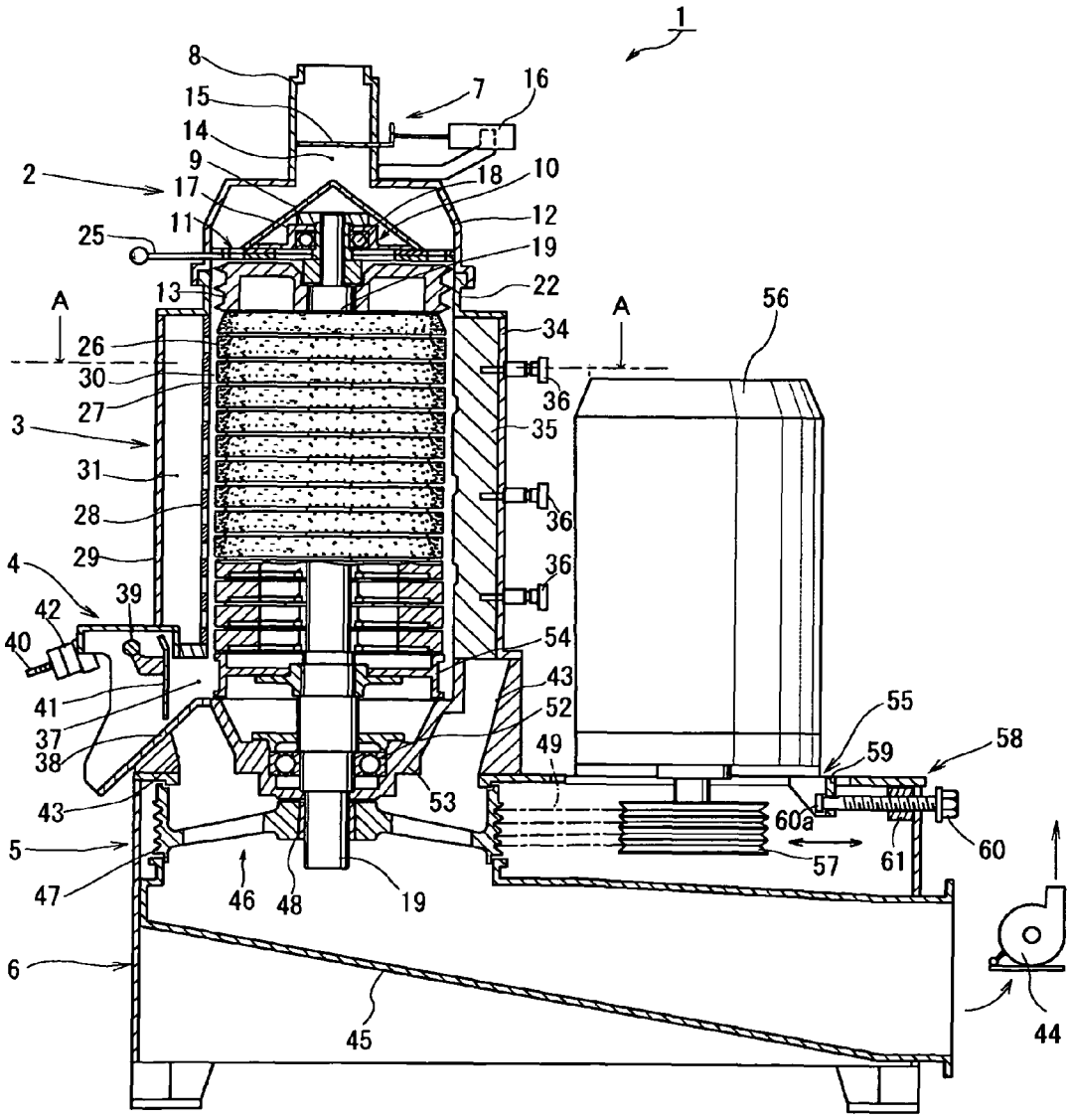
FIG. 1 is a longitudinal sectional view illustrating a grinding type vertical grain milling machine of the invention.

As shown in FIG. 1, a grinding type vertical grain milling machine 1 according to an embodiment of the invention mainly includes a grain supply unit 2 that supplies a grain to be milled, a grinding type grain milling unit 3 that mills the grain received from the grain supply unit 2 while conveying it to a lower grain discharge unit 4, the grain discharge unit 4 that discharges the grain milled at the grinding type grain milling unit 3, a bran collecting unit 5 that collects bran separated from a milled grain at the grinding type grain milling unit 3, and a body base portion 6 that supports a machine body and a motor as a driving source.

(Grain Supply Unit)

The grain supply unit 2 includes a grain supply cylinder 8 that receives a grain supplied from a raw material tank (not shown) or the like, a shutter mechanism 7 that is provided at the grain supply cylinder 8 so as to selectively open or block an acceptance of the grain, a conical guide body 9 that disperses the grain received from the grain supply cylinder 8 in the circumferential direction, an upper bearing portion 10 that is disposed inside the guide body 9, a flow rate adjusting device 11 that adjusts a supply flow rate of the grain, a cover body 12 (FIG. 2) that receives the guide body 9, the upper bearing portion 10, and the flow rate adjusting device 11, and a conveying spiral 13 that sends the grain from the flow rate adjusting device 11 to the grinding type grain milling unit 3.

The shutter mechanism 7 includes an opening and closing valve 15 that is provided at a supply port 14 and an opening and closing driving unit 16 that serves as an air cylinder provided outside the grain supply cylinder 8 and opening and closing the opening and closing valve 15.

The top portion of the guide body 9 is disposed right blow the grain supply cylinder 8, and has a structure in which the grain dropped from the guide body 9 directly flows down along the conical portion to be evenly dispersed radially.

Figure 2:
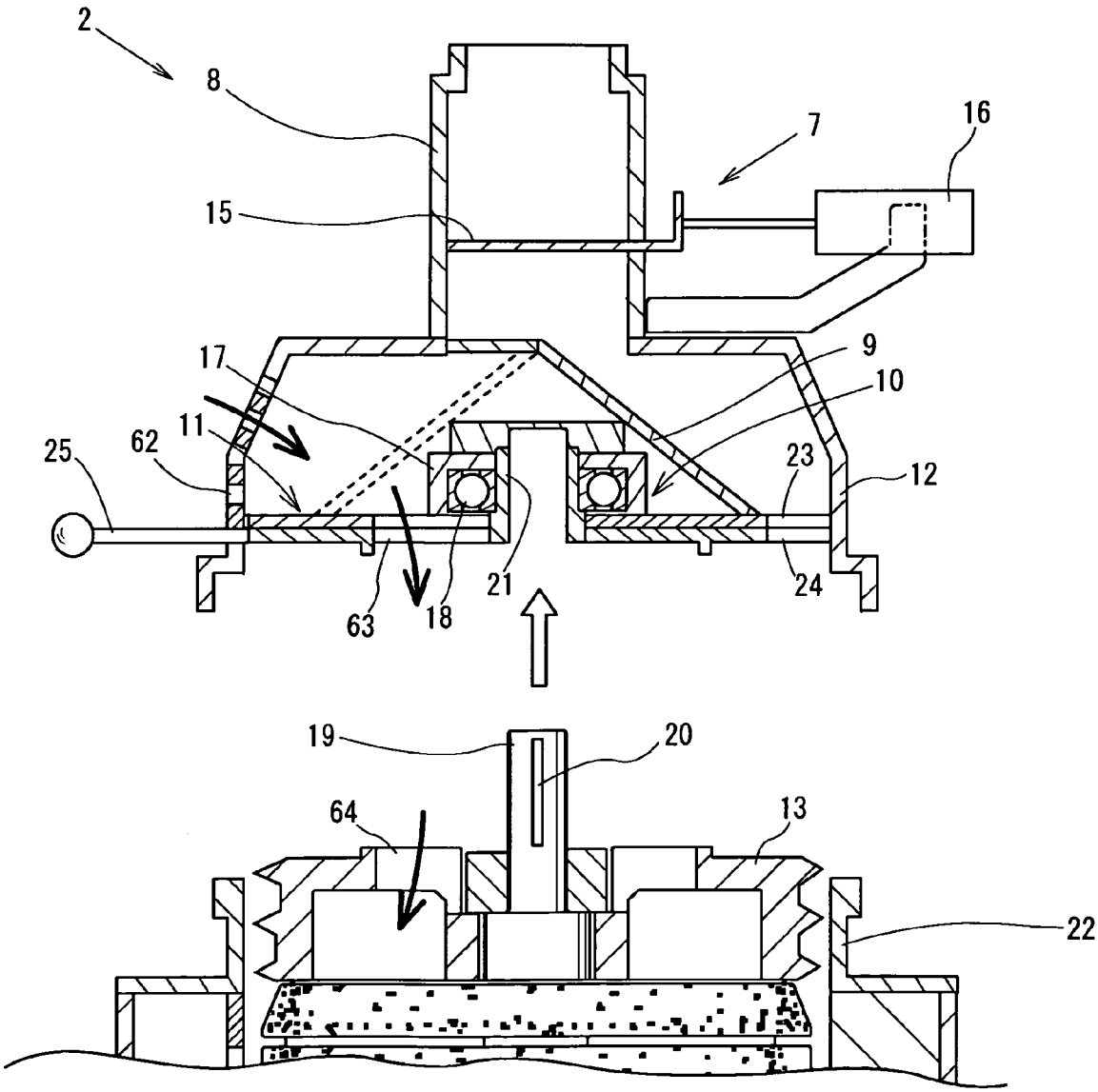
FIG. 2 is a main enlarged cross-sectional view illustrating an upper portion of FIG. 1.

The upper bearing portion 10 includes a bearing cover 17 and a bearing 18 (FIG. 2) disposed inside the bearing cover 17, and rotatably supports the upper portion of a main shaft 19 perpendicularly supported. At this time, a collar 21 is provided between the main shaft 19 and the bearing 18 so that a key 20 is fitted thereto, and may easily take the grain supply unit 2 and the grinding type grain milling unit 3 apart. That is, as shown in FIG. 2, when the cover body 12 of the grain supply unit 2 is extracted upward from a casing 22 of the grinding type grain milling unit 3, the collar 21 is separated from the main shaft 19, and the grain supply unit 2 and the grinding type grain milling unit 3 are taken apart. Accordingly, at the time of replacing a grinding type grain milling roll or the like provided in the grinding type grain milling unit 3, a maintenance work may be easily performed and a work time may be shortened.

The flow rate adjusting device 11 includes a fixed plate 23 that includes a plurality of openings and a rotary plate 24 that includes a plurality of openings and is rotated by an adjusting lever 25 (refer to FIG. 2). Then, the conveying spiral 13 attached to the main shaft 19 is rotatably disposed below the flow rate adjusting device 11 so as to send the grain to the grinding type grain milling unit 3.

The peripheral wall of the cover body 12 (refer to FIG. 2) is provided with a plurality of external air introducing ports 62, the flow rate adjusting device 11 is provided with openings 63 communicating with the external air introducing port 62, and the top surface of the conveying spiral 13 is provided with a ventilation port 64 that circulates external air, introduced from the external air introducing ports 62 and the openings 63, inside the grinding type grain milling unit 3.

(Grinding Type Grain Milling Unit)

The grinding type grain milling unit 3 mainly includes a plurality of annular grinding type grain milling rolls 26 that are attached to the main shaft 19, a spacer 27 that is inserted between the plurality of grinding type grain milling rolls 26, the plurality of grinding type grain milling rolls 26 forming an integral grinding type grain milling roll body, a bran removing metallic mesh cylinder 28 that includes a porous wall portion and is uprightly formed by interposing a small gap in the circumferential direction of the grinding type grain milling roll body, and a bran removing cover 29 that is uprightly formed by interposing a gap in the circumferential direction of the bran removing metallic mesh cylinder 28, wherein a grain milling chamber 30 is formed between the bran removing metallic mesh cylinder 28 and the grinding type grain milling roll 26, and a bran removing chamber 31 is formed between the bran removing metallic mesh cylinder 28 and the bran removing cover.

Figure 3:
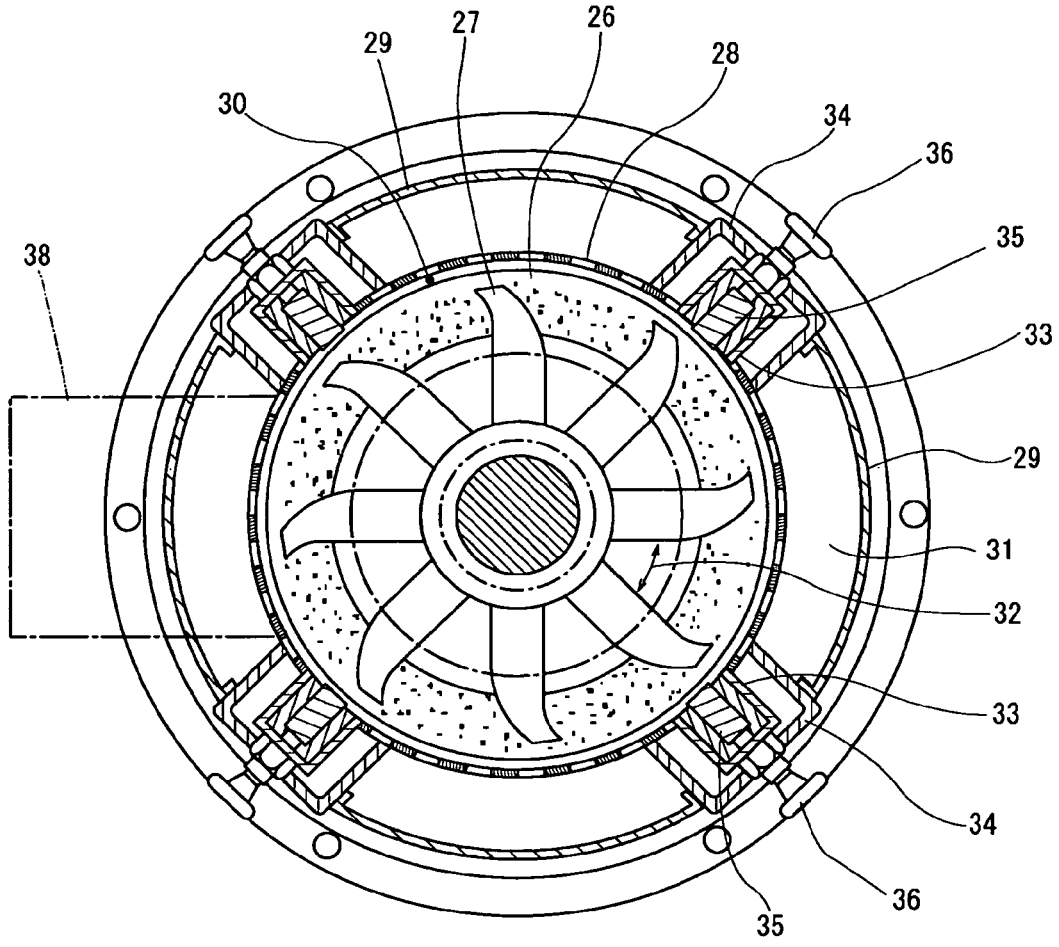
FIG. 3 is a cross-sectional view taken along the line A-A of FIG. 1.

The annular grinding type grain milling roll 26 has a concentric cross-section, and abrasive grains of a grinding stone are buried in the outer peripheral surface thereof in the entire circumference thereof. A grinding portion 26*a* (refer to FIG. 4) of the grinding type grain milling roll 26 is connected to a boss portion 26*c* through an arm portion 26*b*. Although the spacer 27 is inserted between the plurality of grinding type grain milling rolls 26, a space portion without the spacer 27 is disposed in the grain milling chamber 30 so as to serve as an air blowing port 32 (refer to FIG. 3).

The bran removing metallic mesh cylinder 28 is formed in a vertical split shape divided into four parts (refer to FIG. 3), and both edges of each bran removing metallic mesh cylinder are fixed by four support columns 33 uprightly formed around the grinding type grain milling roll 26. Furthermore, each support column 33 is provided with a U-shaped support column cover 34, and an arc-shaped bran removing chamber cover 29 is attached between the support column covers 34.

A resistor 35 is provided at each support column 33 near the grain milling chamber 30 in the longitudinal direction so as to narrow a space of the grain milling chamber 30 in the longitudinal direction. The resistors 35 may be inserted or extracted by a plurality of knob bolts 36 attached to each support column 33.

(Grain Discharge Unit)

The grain discharge unit 4 is disposed at the lower end of the grain milling chamber 30 so as to discharge the grain milled by the grinding type grain milling unit 3. The grain discharge unit 4 includes a discharge port 37 that is formed by opening a part of the bran removing metallic mesh cylinder 28, a discharge cylinder 38 that is connected to the discharge port 37, a weight lever 40 that is fixed to a shaft 39 transversely suspended on the discharge cylinder 38, a resisting plate 41 that is pivoted to one end of the weight lever 40 and faces the discharge port 37 so as to block it, and a weight 42 that is movably attached to the other end of the weight lever 40.

(Bran Collecting Unit)

Figure 5:
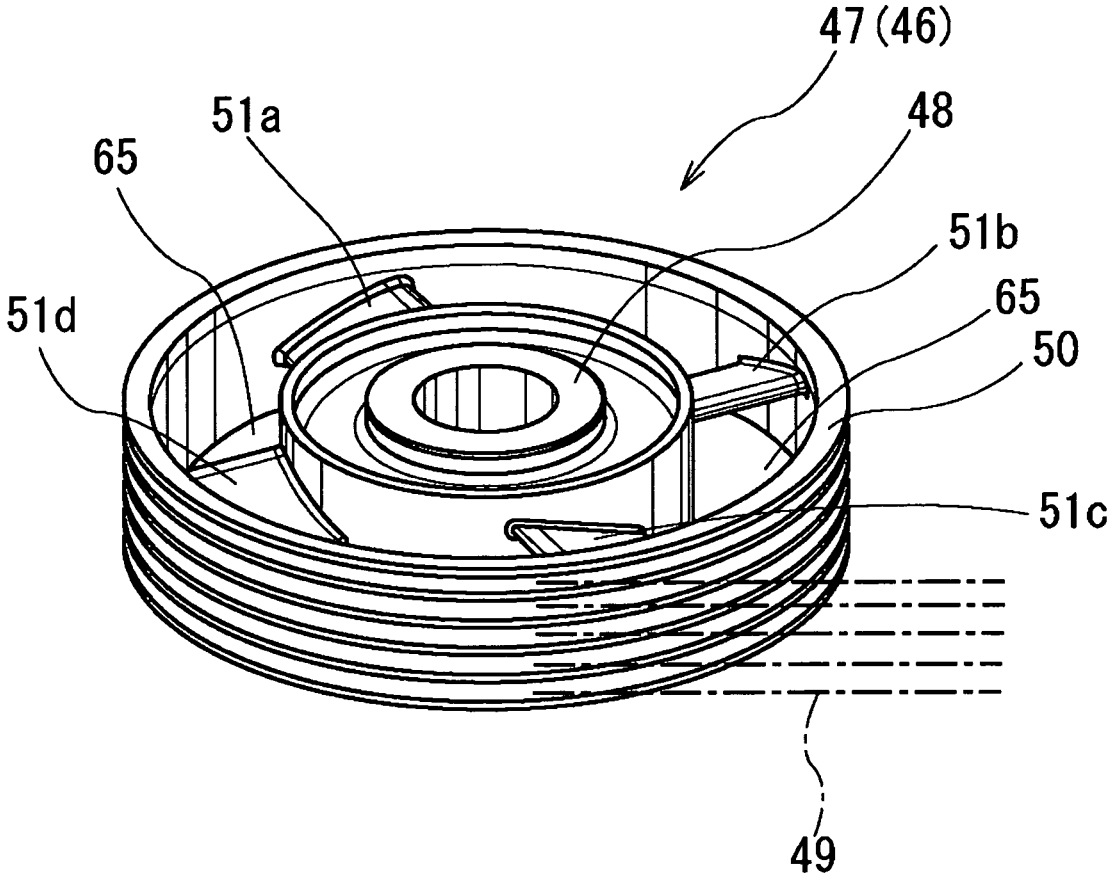
FIG. 5 is an enlarged perspective view of a fan-pulley.
Figure 6:
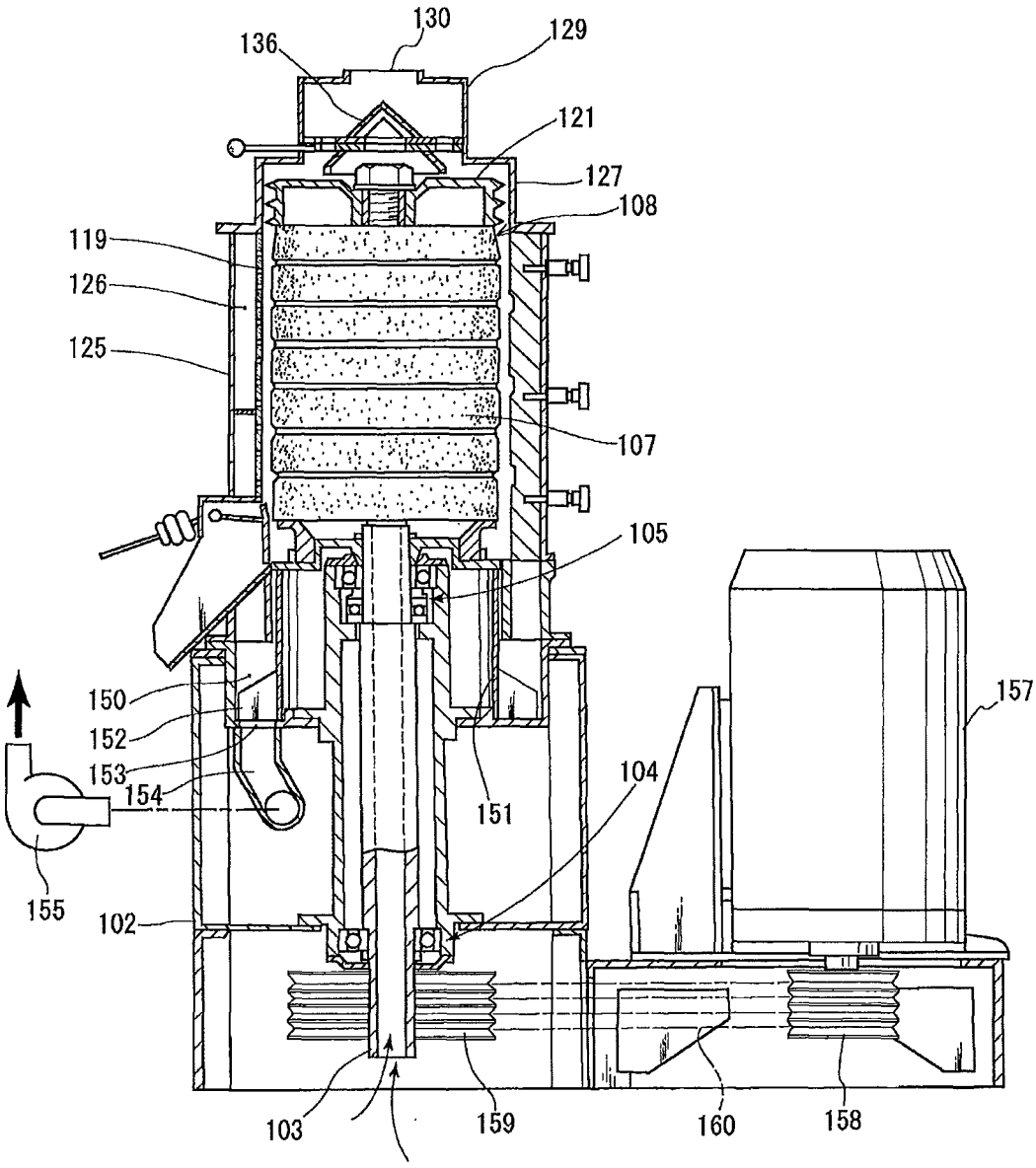
FIG. 6 is a longitudinal sectional view of an existing grinding type vertical grain milling machine.
Figure 7:
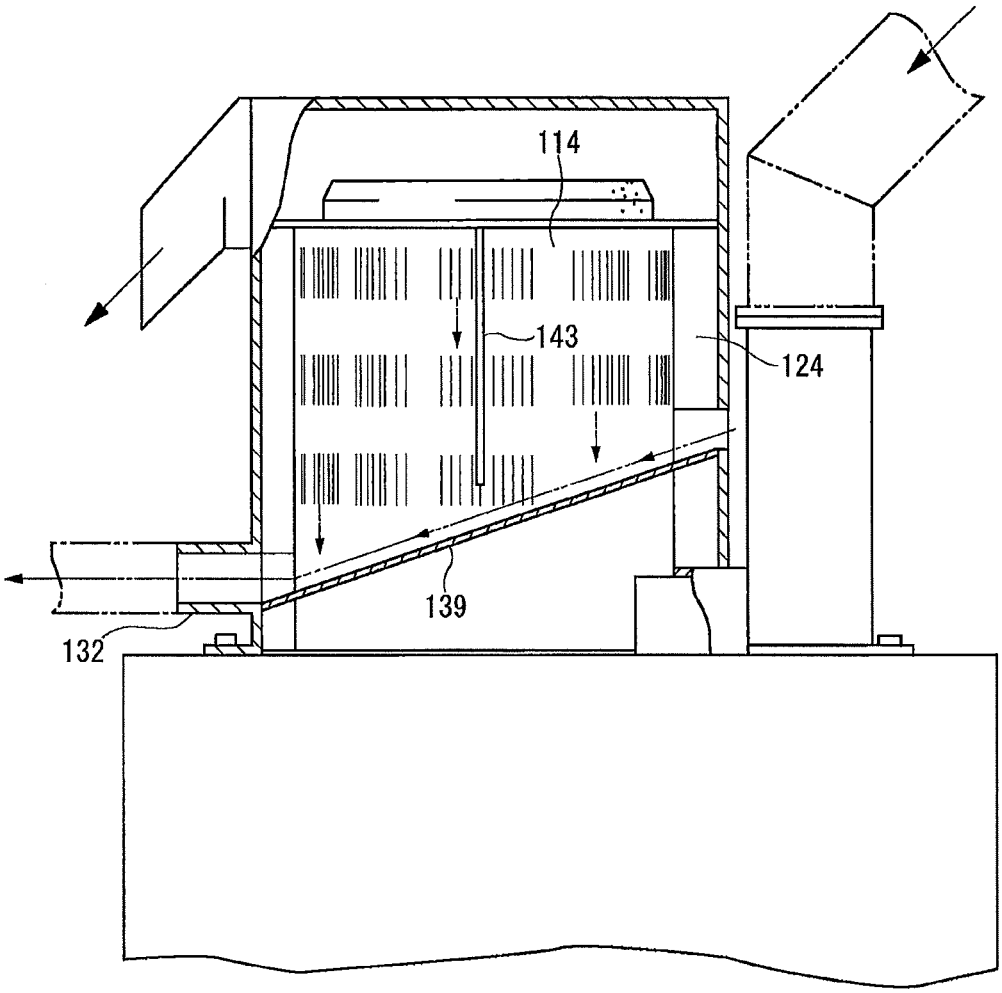
FIG. 7 is a longitudinal sectional view of an existing grinding type vertical grain milling machine.

The bran collecting unit 5 is disposed below the grain discharge unit 4 so as to collect the bran separated from the milled grain at the grinding type grain milling unit 3. The bran collecting unit 5 includes a bran discharge cylinder 43 that communicates with the lower end of the bran removing chamber 31 and a bran discharge pipe 45 that conveys the bran from the bran discharge cylinder 43 to an external bran suction fan 44. Then, a pulley 47, which has a function of a fan 46 generating a bran removing wind by rotation, is disposed at the communication portion between the bran discharge cylinder 43 and the bran discharge pipe 45. As shown in FIG. 5, the pulley 47 includes a boss portion 48 that serves as a shaft center and is fitted to the lower end of the main shaft 19, a rim portion 50 to which a V-belt 49 is attached, and a plurality of arm portions 51*a*, 51*b*, 51*c*, and 51*d* that connects the boss portion 48 and the rim portion 50 to each other and is formed in an axial fan blade shape inclined from the horizontal direction. Then, when the pulley 47 rotates, a bran removing wind is generated downward by the blade-shaped arm portion 51, so that the bran passes through a space portion 65 surrounded by the boss portion 48, the rim portion 50, and the arm portion, moves from the bran discharge cylinder 43 toward the bran discharge pipe 45, and is rapidly discharged.

A lower bearing portion 52 is disposed at the upper portion of the pulley 47 so as to support the main shaft 19. The lower bearing portion 52 is built in a bearing casing 53 fixed to the casing 22, and the main shaft 19 is rotatable by the rotation of the pulley 47. The reference numeral 54 indicates a grain discharge roll that is axially attached to the main shaft 19, and as described above, the grinding type grain milling unit 3 is formed by disposing the plurality of grinding type grain milling rolls 26 on the grain discharge roll 54 in a multi-stage shape.

(Body Base Portion)

A motor base 55 is attached to the side portion of the body base portion 6 of the lower machine body, a driving motor 56 is fixed to the motor base 55, and the V-belt 49 is connected between the motor pulley 57 and the pulley 47 so as to be interlocked therewith, whereby the rotation of the motor 56 may be transferred to the main shaft 19. Further, a moving device 58 is attached to the body base portion 6 so as to adjust a distance between the shafts of the motor pulley 57 and the pulley 47 by moving the motor base 55 in the horizontal direction relative to the body base portion 6.

The moving device 58 includes a hook portion 59 that hangs a screw thereon so as to move the motor base 55 in the horizontal direction, a male screw portion 60 of which the outer periphery is provided with a screw by cutting, and a female screw portion 61 that fixes the inner screw threaded into the male screw portion 60 to the body base portion 2. Then, a front end 60*a* of the male screw portion 60 is fixed to the hook portion 59 and the vicinity of the head portion of the male screw portion 60 is threaded into the female screw portion 61. Accordingly, even when the length of the V-belt 49 wound between the motor pulley 57 and the pulley 47 changes, when the male screw portion 60 is rotated by the amount according to the change, the body base portion 6 and the motor base 55 relatively move, so that the V-belt 49 may be maintained at appropriate tension without looseness.

The bran discharge pipe 45 is transversely provided inside the body base portion 6 so as not to interfere with the pulley 47, the motor pulley 57, and the V-belt 49.

(Operation)

Hereinafter, the operation and the effect of the above-described configuration will be described.

First, the motor 56 as a driving unit is operated so as to rotate the pulley 47, the main shaft 19, and the grinding type grain milling roll 26. In this state, the opening and closing valve 15 is opened by the opening and closing driving unit 16, so that a grain stored in the raw material tank (not shown) or the like is dropped downward from the supply port 14. The dropped grain flows down while being evenly dispersed in the circumferential direction by the guide body 9 present at the downside thereof, and is conveyed to the conveying spiral 13 while being adjusted to an appropriate supply flow rate by the adjusting lever 25.

The conveying spiral 13 sequentially sends the grain to the grain milling chamber 30, and in the grain milling chamber 30, the grain comes into contact with the peripheral surface of the grinding type grain milling roll 26 while undergoing an active flowing action (revolution or rotation) based on a low pressure, so that the surface layer of the grain is scrapped. At this time, in the pulley 47 axially attached to the main shaft 19, the plurality of arm portions 51 of the pulley 47 are formed in a blade shape, and the pulley serves as a fan-pulley that generates a bran removing wind downward. Due to the suction action of the operation of the fan-pulley 47 and the suction action of the operation of the external bran suction fan 44, external air is suctioned from the external air introducing ports 62, and is conveyed into the conveying spiral 13 through the openings 63 and the ventilation ports 64. Then, the external air is conveyed from the inside of the conveying spiral 13 into the grinding type grain milling roll 26, and blows from the air blowing port 32 of the grinding type grain milling roll 26 toward the grain milling chamber 30. The bran passes through the bran removing metallic mesh cylinder 28 by the wind blowing from the grain milling chamber 30, and reaches the bran removing chamber 31. The bran reaching the bran removing chamber 31 is evenly suctioned by the bran removing wind generated by the rotation of the fan-pulley 47, and is discharged toward the bran discharge pipe 45. At this time, since the fan-pulley 47 is formed in the axial fan blade shape, the entire bran removing chamber is evenly suctioned downward, so that the bran is extremely effectively discharged.

Furthermore, in general, the performance of the fan is determined by the number of rotations, the diameter, the thickness, or the shape of the fan. The volume of blowing air increases with an increase in the number of rotations and the diameter, and the air input and output area increases with an increase in the thickness of the fan. In the fan-pulley 47 of the embodiment, a strong bran removing wind may be generated in accordance with a design, but a problem arises in that dust scatters around the milling machine. For this reason, in the embodiment, the diameter is designed to be from 600 mm to 800 mm and preferably to about 710 mm. The number of rotations is designed to be from 500 rpm to 700 rpm and preferably to about 600 rpm. Accordingly, it is supposed that a weak bran removing wind is generated to contribute to rapid bran discharging.

As described above, the grain undergoing the grain milling action by the plurality of grinding type grain milling rolls 26 reaches from the lowermost-stage grinding type grain milling roll 26 to the grain discharge roll 54, and is discharged to the outside of the machine as a milled grain through the discharge port 37 and the discharge cylinder 38 against the resisting plate 41 while undergoing a thrusting action of the grain discharge roll 54.

Next, referring to FIG. 4, a structure for preventing the bran leaking from the fan-pulley 47 provided at the communication portion between the bran discharge cylinder 43 and the bran discharge pipe 45 will be described.

Figure 4:
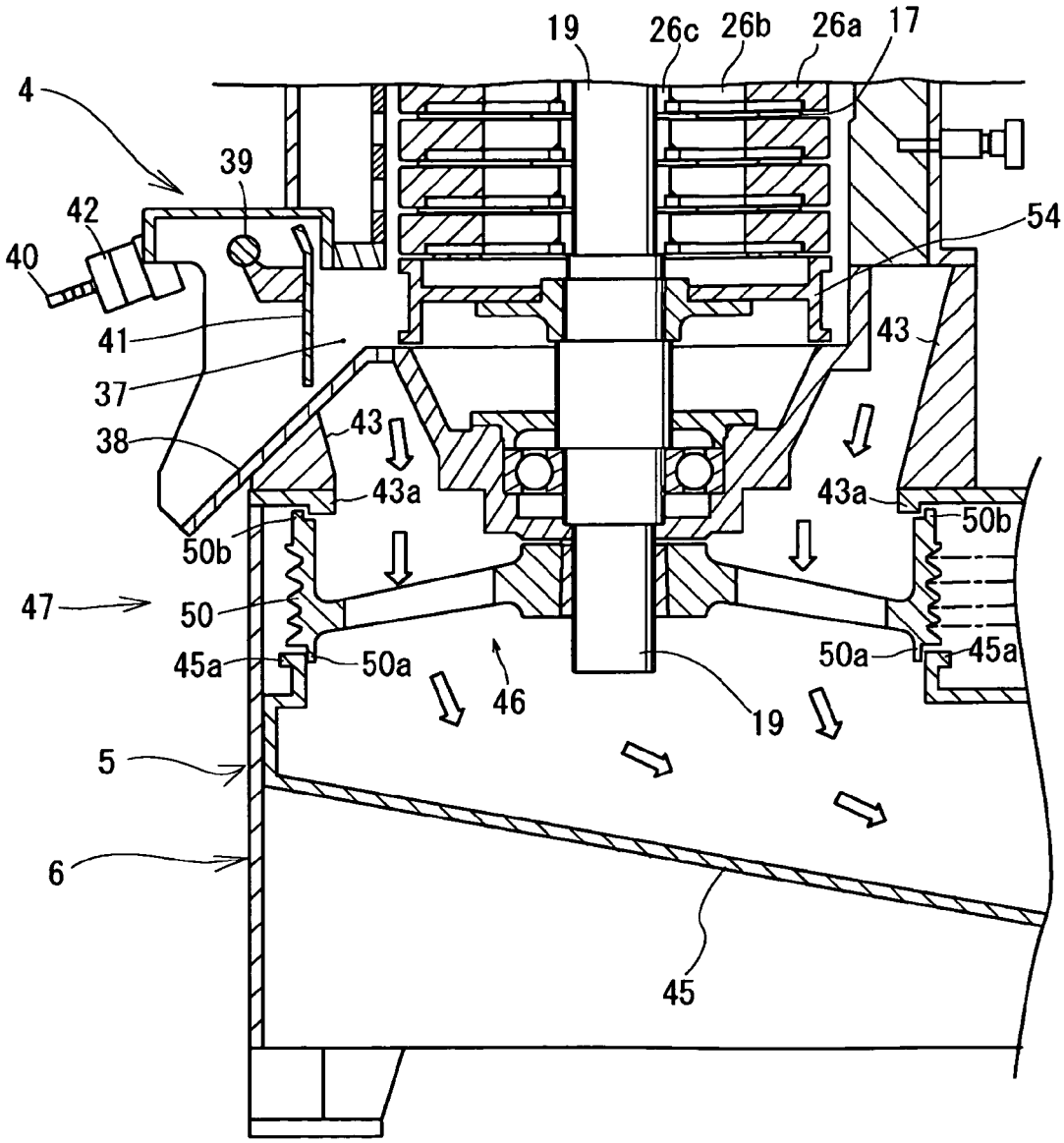
FIG. 4 is a main enlarged cross-sectional view illustrating a lower portion of FIG. 1.

As shown in FIG. 4, a lower edge 50*a* is formed at the lower portion of the rim portion 50 of the pulley 47 so that the inner periphery of the rim portion protrudes downward, and an outer edge 47*b* is formed at the upper portion of the rim portion 50 of the pulley 47 so that the outer periphery of the rim portion protrudes upward. Then, an outer receiving flange 45*a* is formed near the bran discharge pipe 45 so as to receive the inner peripheral edge 50*a* of the rim portion 50 from the outside thereof. On the other hand, an inner receiving flange 43*a* is formed in the bran discharge cylinder 43 near the bran removing chamber 31 so as to be received by the outer peripheral edge 50*b* of the rim portion 50. Accordingly, when the bran flows from the bran discharge cylinder 43 into the fan-pulley 47, it is possible to prevent the bran from being dropped over the pulley 47 even when the pulley 47 rotates since the inner receiving flange 43*a* is received by the outer peripheral edge 50*b* of the pulley 47. Further, when the bran flows from the fan-pulley 47 into the bran discharge pipe 45, it is possible to prevent the bran from being dropped over the bran discharge pipe 45 even when the pulley 47 rotates since the inner peripheral edge 50*a* of the pulley 47 is received by the outer receiving flange 45*a*.

As described above, according to the grinding type vertical grain milling machine of the embodiment of the invention, since the fan-pulley, which has a function of rotationally driving the main shaft having the grinding type grain milling roll body axially attached thereto and a function of generating the bran removing wind for conveying the bran produced by the milling action of the grinding type grain milling roll from the bran removing chamber toward the bran discharge pipe, is provided at the communication portion between the bran removing chamber and the bran discharge pipe, it is not necessary to provide the existing component such as the annular bran collecting chamber provided below the bran removing chamber and the scraping blade sliding on the bottom surface of the annular bran chamber. As a result, the dimension of the machine body of the grinding type vertical grain milling machine in the vertical direction may be shortened. Further, since the fan-pulley is provided, the rotation is transferred from the driving unit to the main shaft, and the bran removing wind is generated. Accordingly, there are excellent operation and effect in that the existing scraping blade for discharging the bran is not provided and the installation space is not needed.

The present invention may be applied to various grain producing machines that need both a function of rotating a main shaft and a function of generating a wind by the rotation of a main shaft.

DESCRIPTION OF REFERENCE NUMERALS

1: GRINDING TYPE VERTICAL GRAIN MILLING MACHINE
2: GRAIN SUPPLY UNIT
3: GRINDING TYPE GRAIN MILLING UNIT
4: GRAIN DISCHARGE UNIT
5: BRAN COLLECTING UNIT
6: BODY BASE PORTION
7: SHUTTER MECHANISM
8: GRAIN SUPPLY CYLINDER
9: GUIDE BODY
10: UPPER BEARING PORTION
11: FLOW RATE ADJUSTING DEVICE
12: COVER BODY
13: CONVEYING SPIRAL
14: SUPPLY PORT
15: OPENING AND CLOSING VALVE
16: OPENING AND CLOSING DRIVING UNIT
17: BEARING COVER
18: BEARING

19: MAIN SHAFT
20: KEY
21: COLLAR
22: CASING
23: FIXED PLATE
24: ROTARY PLATE
25: ADJUSTING LEVER
26: GRINDING TYPE GRAIN MILLING ROLL
27: SPACER
28: BRAN REMOVING METALLIC MESH CYLINDER
29: BRAN REMOVING COVER
30: GRAIN MILLING CHAMBER
31: BRAN REMOVING CHAMBER
32: AIR BLOWING PORT
33: SUPPORT COLUMN
34: SUPPORT COLUMN COVER
35: RESISTOR
36: KNOB BOLT
37: DISCHARGE PORT
38: DISCHARGE CYLINDER
39: SHAFT
40: WEIGHT LEVER
41: RESISTING PLATE
42: WEIGHT
43: BRAN DISCHARGE CYLINDER
44: BRAN SUCTION FAN
45: BRAN DISCHARGE PIPE
46: FAN
47: PULLEY
48: BOSS PORTION
49: V-BELT
50: RIM PORTION
51: ARM PORTION
52: LOWER BEARING
53: BEARING CASING
54: GRAIN DISCHARGE ROLL
55: MOTOR BASE
56: MOTOR
57: MOTOR PULLEY
58: MOVING DEVICE
59: HOOK PORTION
60: MALE SCREW PORTION
61: FEMALE SCREW PORTION
62: EXTERNAL AIR INTRODUCING PORT
63: OPENING
64: VENTILATION PORT
65: SPACE PORTION

What is claimed is:

1. A grain milling machine comprising:

a main shaft that is perpendicularly and rotatably supported to a body base;

a cylindrical integral grain milling roll body that is formed in a cylindrical shape in the vertical direction by disposing a plurality of annular grain milling rolls in multiple stages;

a cylindrical bran removing metallic mesh cylinder;

a cylindrical bran removing cover; and a bran discharge pipe, wherein the grain milling roll body is attached to the main shaft so as to rotate together with the main shaft, the bran removing metallic mesh is disposed outside the grain milling roll body to be fixed to the body base and forms a grain milling chamber between the bran removing metallic mesh and the grain milling roll body, the bran removing cover is disposed outside the bran removing metallic mesh to be fixed to the body base and forms a bran removing chamber between the bran removing cover and the bran removing metallic mesh, the bran discharge pipe is disposed so as to communicate with the lower portion of the bran removing chamber, a motor rotationally driving the main shaft is disposed below the main shaft while being supported to a motor base, a fan-pulley is attached to the communication portion between the bran removing chamber and the bran discharge pipe in the main shaft, the fan-pulley having a function of rotationally driving the main shaft and a function of generating a bran removing wind for conveying bran produced by the grain milling action of the grain milling roll body from the bran removing chamber toward the bran discharge pipe, a conveying belt is wound between a motor pulley of the motor and the fan-pulley attached to the main shaft, and a moving device which adjusts a distance between the shafts of the motor pulley and the fan-pulley by moving the motor base relative to the body base portion in the horizontal direction is provided.

2. The grain milling machine according to claim 1, wherein the fan-pulley includes:

a boss portion that is fitted to the main shaft to which the grain milling roll body is attached, a rim portion on which a rotationally driving conveying belt is mounted, and a plurality of arm portions that connect the boss portion and the rim portion to each other and are formed in an axial fan blade shape inclined from the horizontal direction so that the entire bran removing chamber is evenly suctioned.

3. The grain milling machine according to claim 1, wherein a lower portion of a rim portion of the fan-pulley is provided with an inner edge formed by protruding the inner periphery of the rim portion downward, an upper portion of the rim portion is provided with an outer edge formed by protruding the outer periphery of the rim portion upward, the bran discharge pipe is provided with an outer receiving flange receiving the inner edge from the outside thereof, and the bran removing chamber is provided with an inner receiving flange received inside the outer edge.

4. The grain milling machine according to claim 1, wherein the diameter of the fan-pulley is set to from 600 mm to 800 mm and the number of rotations thereof is set from 500 rpm to 700 rpm.

* * * * *